US005151735A

United States Patent [19]

Yamashita et al.

[11] Patent Number: 5,151,735

[45] Date of Patent: Sep. 29, 1992

[54] SHEET STORING APPARATUS WITH A PLURALITY OF TRAYS

[75] Inventors: Hiroki Yamashita, Okazaki; Kiyoshi Emori, Toyokawa, both of Japan

[73] Assignee: Minolta Camera Kabushiki Kaisha, Osaka, Japan

[21] Appl. No.: 734,962

[22] Filed: Jul. 24, 1991

[30] Foreign Application Priority Data

Jul. 26, 1990 [JP] Japan ..... 2-200060

[51] Int. Cl.[5] ..... G03G 15/00

[52] U.S. Cl. ..... 355/207; 355/322

[58] Field of Search ..... 355/207, 321, 322, 323; 270/52; 271/217, 278, 279, 280, 285, 286, 215

[56] References Cited

U.S. PATENT DOCUMENTS

| | | | |
|---|---|---|---|
| 4,295,733 | 10/1981 | Janssen et al. | 355/323 |
| 4,327,993 | 5/1982 | Gauronski et al. | 355/207 |
| 4,688,924 | 8/1987 | Anzai et al. | 355/323 |
| 4,927,131 | 5/1990 | Hashimoto et al. | 271/215 |
| 4,994,865 | 2/1991 | Nishimori et al. | 355/324 |

FOREIGN PATENT DOCUMENTS 60-64880 4/1985 Japan .

*Primary Examiner*—Joan H. Pendegrass
*Assistant Examiner*—Christopher Horgan
*Attorney, Agent, or Firm*—Willian, Brinks, Olds, Hofer, Gilson & Lione

[57] ABSTRACT

A sheet storing apparatus for stacking sheets discharged from a printer and storing the sheets therein, the apparatus having a plurality of trays, separate driving systems of the trays, and a detector for detecting failure in sheet storing operation on each of the trays. When the detector detects failure in sheet storing operation on one of the trays, successive sheets are transported to another tray. Further, each of the trays has a mechanism for moving the tray horizontally and a mechanism for moving the tray vertically, and the movements of the trays are independent. When it is detected that one of the trays has trouble in its horizontal movement mechanism and/or vertical movement mechanism, sheets are received on the other trays.

16 Claims, 19 Drawing Sheets

1
2
10
11
12
13
14
15
16
17
21
22
23
24
25
26
27
28
30
31
32
33
35
36
37
40
50
51
52
53
54
55
56
57
58
60
61
62
63
64
65
66
67
70
70a
71
71a
73
73a
74
74a
75
75'
75a
75a'
76
76a
77
77a
SE1
SE1a
SE2
SE2a
SE3
SE3a
SE4
SE4a
SE5
SE5a
SE11
SE12
SE13
SE14
P
Q

A
S13a
MODE 7,8,9 ?
YES
NO
S25
UNIT INOPERATIVE SIGNAL GENERATED
RETURN
S21
PRECEDING SHEET RECEIVER = UPPER TRAY ?
YES
NO
S22
CURRENT SHEET RECEIVER = UPPER TRAY ?
YES
S23
CURRENT SHEET RECEIVER = LOWER TRAY ?
YES
NO
NO
S22a
MODE 4,5,6 ?
YES
NO
S24
UPPER TRAY HORIZONTAL MOVEMENT
B

SHEET STORING APPARATUS WITH A PLURALITY OF TRAYS

BACKGROUND OF THE INVENTION

1. Field of the Invention

The present invention relates to a sheet storing apparatus, and more particularly to a sheet storing apparatus for stacking sheets discharged from an image forming apparatus, such as an electrophotographic machine and a laser printer, on a tray.

2. Description of Related Art

In a laser printer, occasionally a large number of sheets are printed in continuous printing operation, and therefore a type of sheet storing apparatus having a plurality of capacious stacking tables such as trays or stackers has been developed into various models to be provided for laser printers. Generally, such a sheet storing apparatus has a mechanism for moving down the stacking table intermittently with growth of a sheet stack on the table, and a mechanism for moving the stacking table horizontally at predetermined intervals to enable offset sheet stacking on the table. Further, the apparatus is so made that each sheet is transported onto one of the stacking tables selectively.

In the sheet storing apparatus, even when sheet jamming takes place near or on one of the stacking tables or when motor trouble occurs in one of the mechanisms, it is theoretically possible to continue sheet storing by using the other stacking tables. In conventional sheet storing apparatuses of this type, however, in such a situation, the whole system is run down to discontinue the sheet storing operation, and the printing operation in the image forming apparatus is also discontinued. In order to resume the operation, the operator must check the inside of the image forming apparatus and remove the jammed sheet from the apparatus, which is inconvenient. Also, when at least one of the mechanisms has motor trouble, the apparatus cannot be in a stand-by condition in spite of supply of electricity. In such a case, the apparatus must wait for repair of the motor by a serviceman.

SUMMARY OF THE INVENTION

An object of the present invention is to provide a sheet storing apparatus which can continue sheet storing operation even when failure in sheet storing is detected in one of stacking tables.

Another object of the present invention is to provide a sheet storing apparatus which can be in a stand-by condition even when its driving system partly malfunctions.

In order to attain the objects, a sheet storing apparatus according to the present invention comprises a plurality of sheet storing means which have separate driving means to enable independent sheet storing operation; detection means for detecting failure in the sheet storing operation of each of the sheet storing means; and control means for, when the detection means detects failure in the sheet storing operation of one of the sheet storing means, controlling another sheet storing means to perform the sheet storing operation.

Failure in the sheet storing operation is, for example, sheet jamming or motor trouble. When such failure is detected in one of the sheet storing means, the sheet storing apparatus is controlled to transport successive sheets to another sheet storing means. Accordingly, image formation in the image forming machine need not be discontinued. Thus, this control system saves operators trouble to resume the image formation.

Each of the sheet storing means of the apparatus has a tray and means for moving the tray horizontally at predetermined intervals so that offset sheet storing can be performed. In the apparatus, when sheet storing operation is switched from one of the sheet storing means to another of the sheet storing means in response to detection of trouble in the former sheet storing means, the horizontal movement means of the latter sheet storing means operates so that successive sheets will be received in a different portion of the sheet storing means. Thereby the sheets transported to the sheet storing means after the trouble can be distinguished from those transported thereto before the trouble.

Another sheet storing apparatus according to the present invention comprises a plurality of sheet storing means which have separate driving means to enable independent sheet storing operation; detection means for detecting a malfunction of each of the driving means, the detection means operating simultaneously with applying power to the sheet storing apparatus; and control means for, when the detection means detects a malfunction of one of the driving means, controlling another driving means to drive the corresponding sheet storing means to perform the sheet storing operation.

In other words, when motor trouble is detected in part of the driving system, the other part of the driving system normally operative is used for the sheet storing operation. Thus, the sheet storing apparatus can be in a stand-by condition even when the driving system partly malfunctions.

BRIEF DESCRIPTION OF THE DRAWINGS

These and other objects and features of the present invention will become apparent from the following description taken in conjunction with the preferred embodiments thereof in reference to the accompanying drawings, in which:

FIG. 1 is a schematic view of a whole system including a printer showing the general construction;

FIG. 2 is a perspective view of a main part of a mechanism for reciprocating a tray horizontally;

FIGS. 3 and 4 are block diagrams showing a control circuit;

FIG. 5 is a flowchart showing a main routine of a CPU of a control processor for a sheet storing unit;

FIG. 6 is a flowchart showing a subroutine for sheet storing;

FIG. 7 is a flowchart showing a subroutine for jam detection;

FIGS. 8 through 21 show a sheet storing apparatus of a second embodiment according to the present invention, and more particularly a control procedure performed by a CPU of its control processor;

FIG. 8 is a flowchart showing a subroutine for initialization;

FIG. 9 is a flowchart showing a subroutine for initialization of a vertical movement mechanism of an upper tray;

FIG. 10 is a flowchart showing a subroutine for timer processing;

FIG. 12 is a flowchart showing a subroutine for mode selection and motor control;

FIG. 13 is a flowchart showing a subroutine for motor control in mode 1;

FIG. 14 is a flowchart showing a subroutine for motor control in mode 2;

FIG. 15 is a flowchart showing a subroutine for motor control in mode 3;

FIG. 16 is a flowchart showing a subroutine for motor control in mode 4;

FIG. 17 is a flowchart showing a subroutine for motor control in mode 5;

FIG. 18 is a flowchart showing a subroutine for motor control in mode 6;

FIG. 19 is a flowchart showing a subroutine for motor control in mode 7;

FIG. 20 is a flowchart showing a subroutine for motor control in mode 8; and

FIG. 21 is a flowchart showing a subroutine for motor control in mode 9.

DETAILED DESCRIPTION OF THE PREFERRED EMBODIMENTS

Some exemplary sheet storing apparatuses according to the present invention are hereinafter described in reference to the accompanying drawings. In each embodiment, described is a sheet storing unit which comprises two trays, each of the trays having a mechanism for moving the tray vertically and a mechanism for moving the tray horizontally.

FIRST EMBODIMENT: FIGS. 1-7

Figure 1:
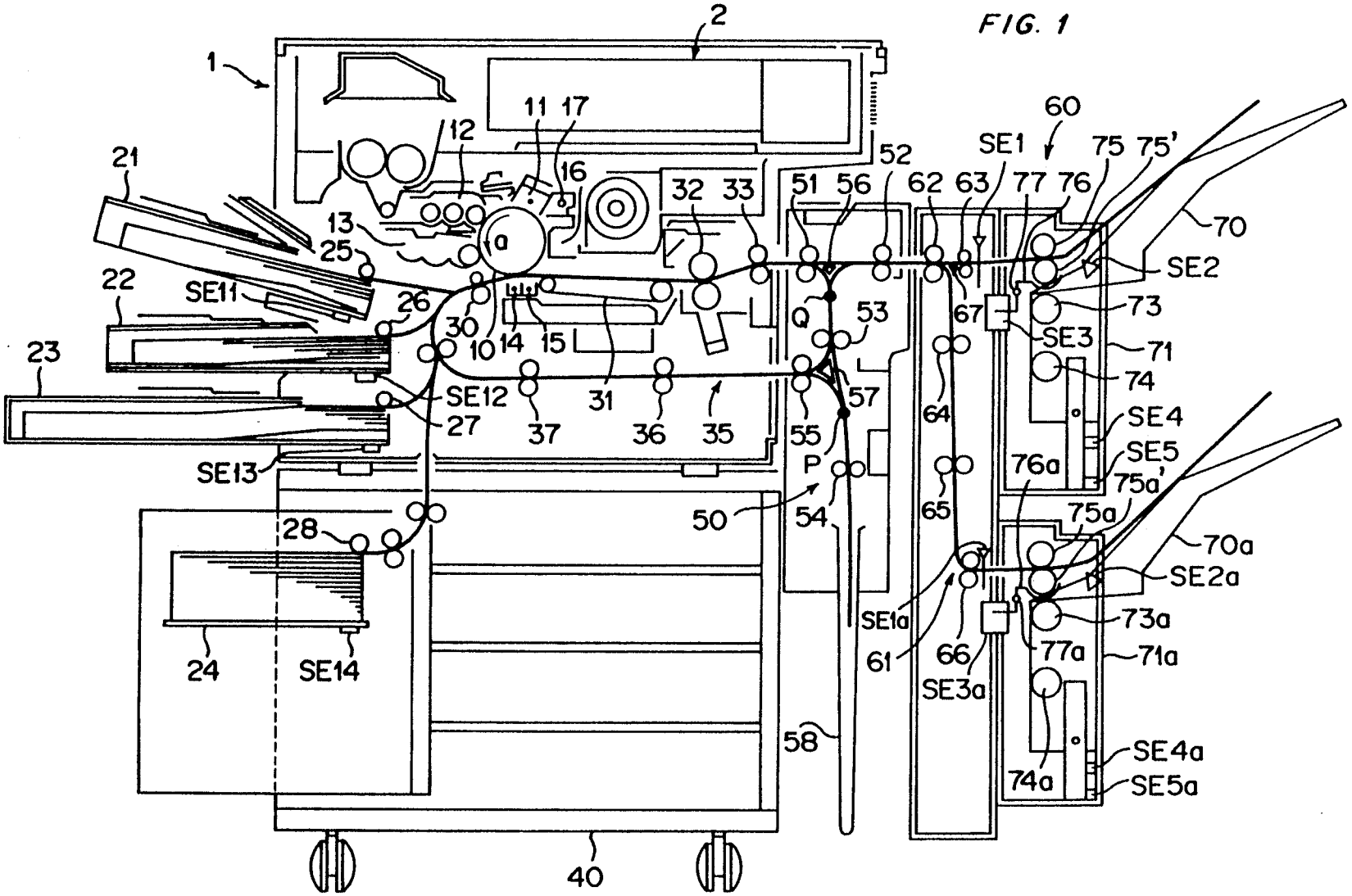
FIGS. 1 through 7 show a first embodiment of a sheet storing apparatus according to the present invention.

FIG. 1 shows a laser printer which essentially consists of a printer body 1, a sheet reversing unit 50 and a sheet storing unit 60. The sheet reversing unit 50 is between the body 1 and the sheet storing unit 60.

The body 1 is mounted on a desk 40. In the body 1, a photosensitive drum 10 is disposed approximately in the center, and the photosensitive drum 10 is rotatable in a direction as indicated by arrow a. Around the photosensitive drum 10 there are disposed an electric charger 11, developing devices 12 and 13 adopting a magnetic brush method, a transfer charger 14, a separation charger 15, a cleaning device 16 for removing residual toner from the drum 10, an eraser lamp 17 for erasing residual electrostatic on the drum 10, etc. An electrostatic latent image is formed with a laser beam optical system 2 on the photosensitive drum 10 which has been subjected to a charging process. Since printing operation using these elements is well known, we omit a description of the operation.

Automatic sheet feeding cassettes 21, 22 and 23 are disposed in three stories in the left side of the body 1. Also, an elevating automatic sheet feeding unit 24, which can be optionally installed in the laser printer, is disposed in the desk 40. Sensors SE11 through SE14 are provided below the cassettes 21, 22 and 23, and the unit 24 respectively so as to detect the size of paper sheets stored in each cassette or unit. A sheet source is selected from the cassettes 21, 22 and 23, and the unit 24, and sheets are supplied from the selected cassette or unit one by one by a feeding roller 25, 26, 27 or 28. The bold lines in FIG. 1 indicate sheet paths. A sheet fed from the selected cassette or unit is registered by timing rollers 30, and the sheet is fed to the image transfer station in synchronization with an image formed on the photosensitive drum 10 so as to receive a toner image. The sheet carrying the toner image is conveyed to a fixing device 32 by a conveyer belt 31, and the toner image is fixed on the sheet by heat. Then, the sheet is ejected from the body 1 into the sheet reversing unit 50.

The sheet reversing unit 50 guides the sheet into a sheet refeed path 35 comprising rollers 36 and 37 and leading back to the image transfer station so that the sheet can receive another image on the other side (duplex printing mode) or on the same side (composite printing mode), or guides the sheet into the sheet storing unit 60 with the printed side facing up (non-reversing mode) or with the printed side facing down (reversing mode).

In order to operate in these modes, the sheet reversing unit 50 comprises receiving rollers 51, ejection rollers 52, reversible rollers 53 and 54, refeed rollers 55, diverters 56 and 57, and a switchback path 58. Each of the diverters 56 and 57 is driven by a solenoid (not shown) so as to move between two positions.

In the non-reversing mode, a sheet received by the receiving rollers 51 is guided by the upper surface of the diverter 56, and transported into the sheet storing unit 60 through the ejection rollers 52 with the printed side facing up. In the reversing mode, a sheet received by the receiving rollers 51 is guided by the left surface of the diverter 56. The sheet is transported downward by the forward rotation of the rollers 53, and is guided by the right surface of the diverter 57. The sheet is further transported downward by the forward rotation of the rollers 54, and the leading end of the sheet enters the switchback path 58. When the trailing end of the sheet comes to a point Q, the rollers 53 and 54 are rotated in reverse so as to feed the sheet back. Then, the sheet is guided by the right surface of the diverter 56 and fed to the sheet storing unit 60 through the ejection rollers 52 with the printed side facing down.

In the duplex printing mode, a sheet is guided to the switchback path 58 in the same manner as in the reversing mode. When the trailing end of the sheet comes to a point P, the rollers 54 are rotated in reverse so as to feed the sheet back. The sheet is guided by the left lower surface of the diverter 57 and fed into the refeed path 35 through the refeed rollers 55. In the composite printing mode, a sheet received by the rollers 51 is guided by the left surface of the diverter 56 to the rollers 53. Then, the sheet is guided by the left upper surface of the diverter 57 and fed into the refeed path 35 through the refeed rollers 55.

The sheet storing unit 60 essentially consists of trays 70 and **70*a* of two stories, and a sheet transporting section 61. The trays 70 and 70*a*** are capable of reciprocating horizontally in directions perpendicular to a sheet storing direction and moving vertically in accordance with the volume of a sheet stack thereon.

The sheet transporting section 61 comprises transport rollers 62 through 66, and a diverter 67 disposed between the rollers 62 and 63. The diverter 67 is driven by a solenoid (not shown) to move between two positions. The diverter 67 guides a sheet to the rollers 63 and the upper tray 70 by its upper surface, and guides a sheet downward to the rollers 64, 65 and 66, and the lower tray **70*a* by its left surface. Sheet sensors SE1 and SE1*a* are disposed immediately past the transport rollers 63 and 66** respectively.

The trays 70 and **70*a* are protruded from boxes 71 and 71*a* respectively. The trays 70 and 70*a* are capable of reciprocating horizontally in directions perpendicular to the sheet storing direction, and are capable of reciprocating vertically. Horizontal motors 73 and 73*a*, and vertical motors 74 and 74***a* are disposed under the respective trays 70 and 70*a*, and the horizontal and vertical movements of the trays 70 and 70*a* are performed by separate horizontal movement mechanisms and vertical movement mechanisms (not shown).

Since the trays 70 and 70*a* and their peripheral parts have the same constitution, the following describes only the upper tray 70. In the drawings, parts pertaining to the lower tray 70*a* are referenced by numerals with "a".

Figure 2:
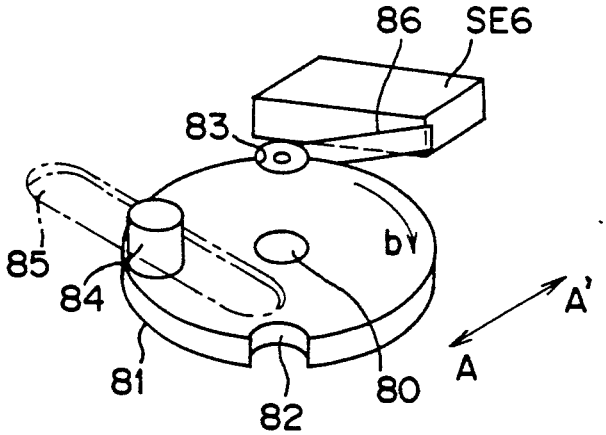

FIG. 2 shows the horizontal movement mechanism. In the mechanism, a cam 81 is disposed on a shaft 80 to which rotating force of the horizontal motor 73 is transmitted, and a pin 84 provided on the cam 81 at a place out of the center thereof engages with a long hole 85 of a plate. The plate moves in directions indicated by arrows A and A' (in the directions perpendicular to the sheet storing direction) together with the tray 70. Notches 82 and 83 are formed on the circumference of the cam 81 at an angle of 180 degrees to each other, and an actuator 86 of the sensor SE6 is engageable with the notches 82 and 83. When specified information has been printed out in the printer body 1, the horizontal motor 73 is energized so as to rotate the cam 81 in a direction indicated by arrow b, such that the tray 70 is moved in the direction of A or A'. Then, when the actuator 86 comes into an engagement with the notch 82 or 83, the sensor SE6 is turned off, and the horizontal motor 73 is turned off. The cam 81 is rotated intermittently by an angle of 180 degrees in this manner, and accordingly the tray 70 is reciprocated in the directions of A and A'. The vertical movement mechanism has a conventional constitution wherein the tray 70 has a rack which engages with a pinion rotated by the vertical motor 74. U.S. Pat. No. 4,973,036 describes such a mechanism. We omit a further description of the vertical movement mechanism.

Now back in FIG. 1, vertically coupled ejection roller pairs 75 are provided in the box 71 so as to transport a sheet fed from the sheet transporting section 61 onto the tray 70. Paddle wheels (not shown) are disposed coaxially with lower rollers 75' of the ejection roller pairs 75, and the paddle wheels rotate together with the lower rollers 75'. The paddle wheels provide a sheet being placed on the tray 70 on the trailing end with force opposing the sheet transporting force, thereby aligning the sheet on the tray 70. The trailing edge of the sheet is stopped and regulated by a plate disposed on the tray 70 in the rear. The tray 70 is provided with a sensor SE2 for detecting sheets on the tray 70.

Further, the tray 70 is provided with a sensor SE3 for detecting the stacking surface of the tray 70 or the top surface of a sheet stack on the tray 70, and an actuator 76, which enable the tray 70 to be maintained in a vertically appropriate position. The appropriate position of the tray 70 means a position where a sheet entering the tray 70 can be provided with the force by the paddle wheels effectively and placed on the tray 70 in alignment. Practically, whether or not the tray 70 is in an appropriate position is judged from the distance between the nipping portion of the ejection roller pairs 75 and the stacking surface of the tray 70 or the top surface of a sheet stack on the tray 70. The appropriate position has a certain range, and the sensor SE3 is to detect that the top surface of a sheet stack on the tray 70 reaches the upper limit of the appropriate position. The actuator 76 is capable of pivoting on a pin 77 and extended onto the rear of the tray 70 along the lower ejection rollers 75'. The actuator 76 is capable of advancing into and retreating from the optical axis of the sensor SE3. The actuator 76 is usually urged clockwise on the pin 77 by a spring (not shown) and in a position indicated by the solid line in FIG. 1. In this state, the sensor SE3 is off. Sheets fed one by one are stacked on the tray 70, and when the top surface of the sheet stack comes to the upper limit of the appropriate position, the actuator 76 is pushed counterclockwise by the topmost sheet, whereby the sensor SE3 is turned on. In response to the on-signal from the sensor SE3, the vertical motor 74 is rotated to move down the tray 70. As the tray 70 is moving down, the actuator 76 turns clockwise toward the initial position. When the sensor SE3 is turned off, the vertical motor 74 is stopped. In this manner, when the top surface of the sheet stack on the tray 70 comes to the upper limit, the tray 70 is moved down by one step of a specified amount.

Sensors SE4 and SE5 are disposed in the lower part of the box 71, and an excess over the capacity of the tray 70 is judged when the sensor SE4 or SE5 detects the tray 70. When sheets of a large size are ejected from the printer body 1 and stacked on the tray 70, the upper sensor SE4 is used, and when the sheets of a small size are stacked on the tray 70, the lower sensor SE5 is used. Which sensor SE4 or SE5 is to be used is determined according to a sheet size signal sent from one of the sensors SE11 through SE14 provided in the sheet feeding section.

When sheets are taken away from the tray 70, the sensor SE2 is turned off, and in response to the off-signal from the sensor SE2, the vertical motor 74 is rotated to move up the tray 70. The upward movement continues until the upper limit sensor SE3 is turned on, and thus the tray 70 returns to the initial position.

Meanwhile, every time specified information has been printed out, the horizontal motor 73 is rotated until the sensor SE6 is turned off, such that the tray 70 is moved horizontally in either of the directions perpendicular to the sheet storing directions by an amount corresponding to the eccentricity of the pin 84 on the cam 80. As a result of said reciprocating motion, a stack of sheets are sorted.

In this embodiment, detection of sheet jamming is performed by combinations of sheet sensors (unillustrated sensors in the sheet reversing unit 50 and the sensors SE1 and SE1*a* in the sheet storing unit 60) and timers. When sheet jamming takes place in or near the upper box 71, the trailing end of the jammed sheet may remain near the diverter 67. Therefore in this case the sheet storing operation is discontinued. However, when sheet jamming takes place in or near the lower box 71*a*, it is obvious that the trailing end of the jammed sheet has already passed the diverter 67. In this case, the sheet jamming does not interfere with sheet storing by use of the upper tray 70, and the sheet storing unit 60 is so controlled that successive sheets are stacked on the upper tray 70. Before the upper tray 70 receives sheets after the sheet jamming, the tray 70 is moved horizontally by one step so that the sheets after the sheet jamming can be distinguished from sheets before the jamming. This control will be described in detail later, referring to flowcharts.

Figure 3:
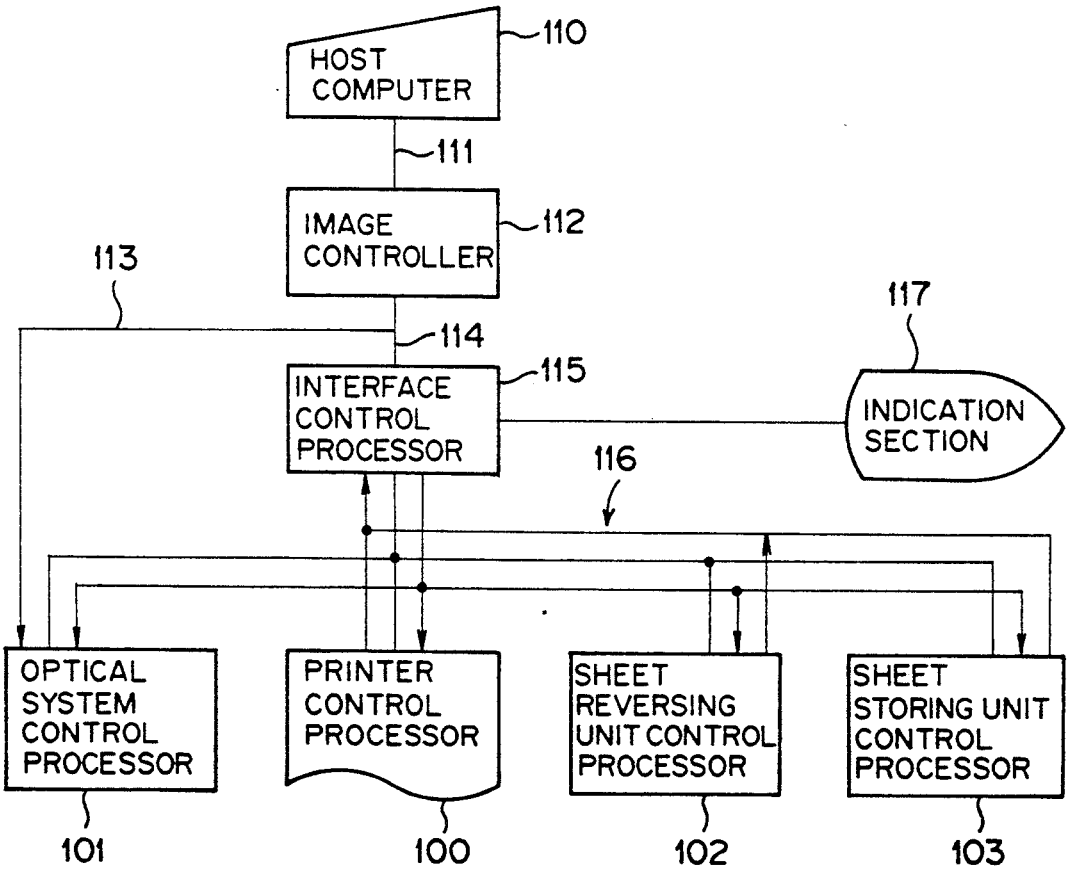

FIG. 3 shows a control circuitry for the whole system.

A control processor 100 controls the printer body 1. A control processor 101 controls the laser beam optical system 2. A control processor 102 controls the sheet reversing unit 50. A control processor 103 controls the sheet storing unit 60. Information to be printed out is transmitted from a host computer 110 to an image controller 112 via a host interface 111. The image controller 112 sends the information to the optical system control processor 101 via a video line 113, and sends information on printing modes, etc. to an interface control processor 115 via a control line 114. The interface control processor 115 corresponds with the processors 100 through 103 via a serial interface 116. The interface control processor 115 receives information on a sheet size, sheet jamming, sheet passing, etc., and provides the processors 100 through 103 with necessary information. Further, the interface processor 115 controls an indication section 117 of an operation panel on the printer body 1. The indication section 117 indicates the states of the processors 100 through 103 by order of the interface control processor 115.

Figure 4:
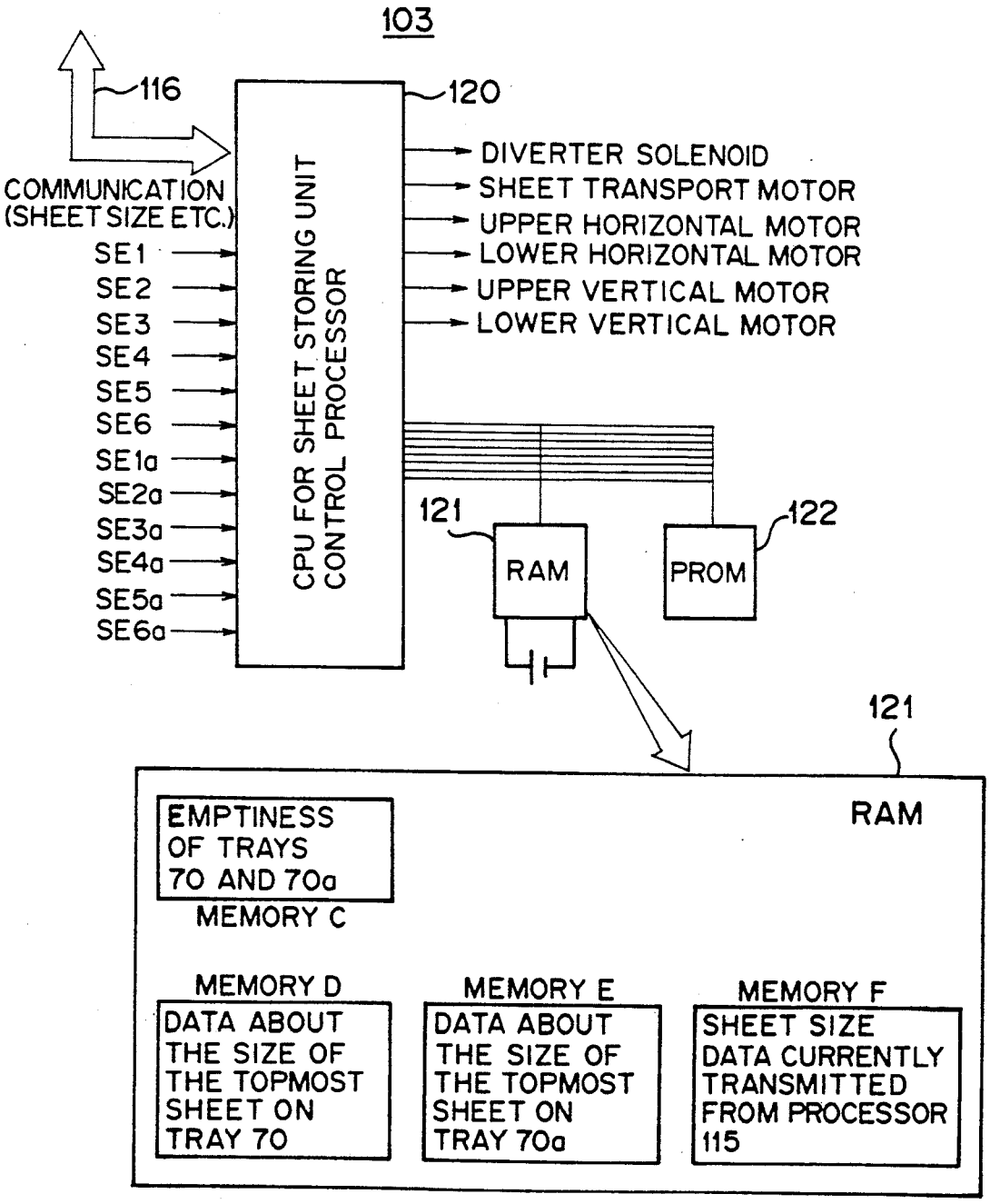

FIG. 4 shows the general constitution of the processor 103 controlling the sheet storing unit 60.

The main component of the processor 103 is a CPU 120, and the processor 103 also comprises an RAM 121 and a PROM 122. The RAM 121 has a memory C to be stored with data about emptiness of the trays 70 and 70*a*, a memory D to be stored with data about the size of the topmost sheet on the upper tray 70, a memory E to be stored with data about the size of the topmost sheet on the lower tray 70*a*, a memory F to be stored with sheet size data currently transmitted from the processor 115. With an output port of the CPU 120 are connected driving circuits of the solenoid of the diverter 67, a sheet transport motor, the horizontal motors 73 and 73*a*, and the vertical motors 74 and 74*a*. With an input port of the CPU 120 are connected the sensors SE1 through SE6 and SE1*a* through SE6*a*.

A control procedure of the sheet storing unit processor 103 is hereinafter described, referring to FIGS. 5, 6 and 7.

Figure 5:
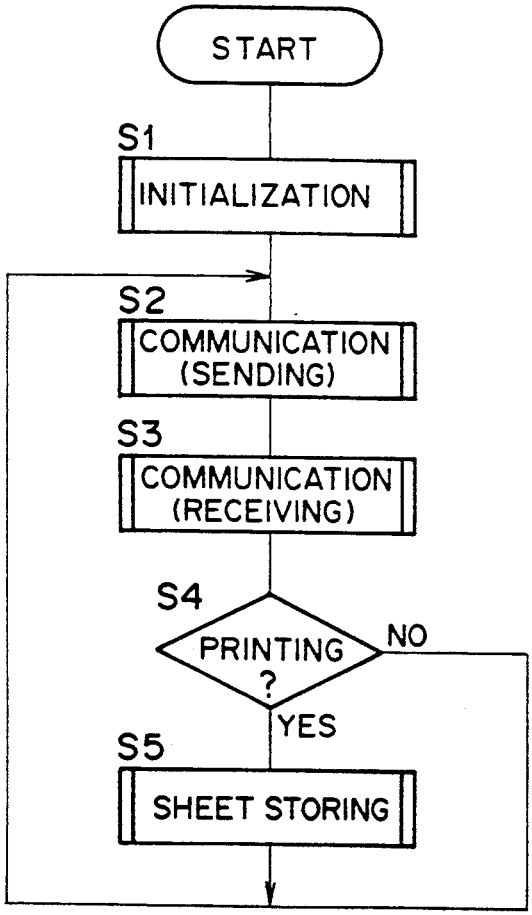

FIG. 5 shows a main routine of the CPU 120. When power is applied to the sheet storing unit 60, a program starts. Step S1 is an initialization step, where all the flags, timers and counters are reset. At steps S2 and S3, the processor 103 communicates with the other processors 100, 101, 102 and 115 via the serial interface 116. When it is judged at step S4 that sequence control for printing has started, a subroutine for sheet storing is performed at step S5.

Figure 6:
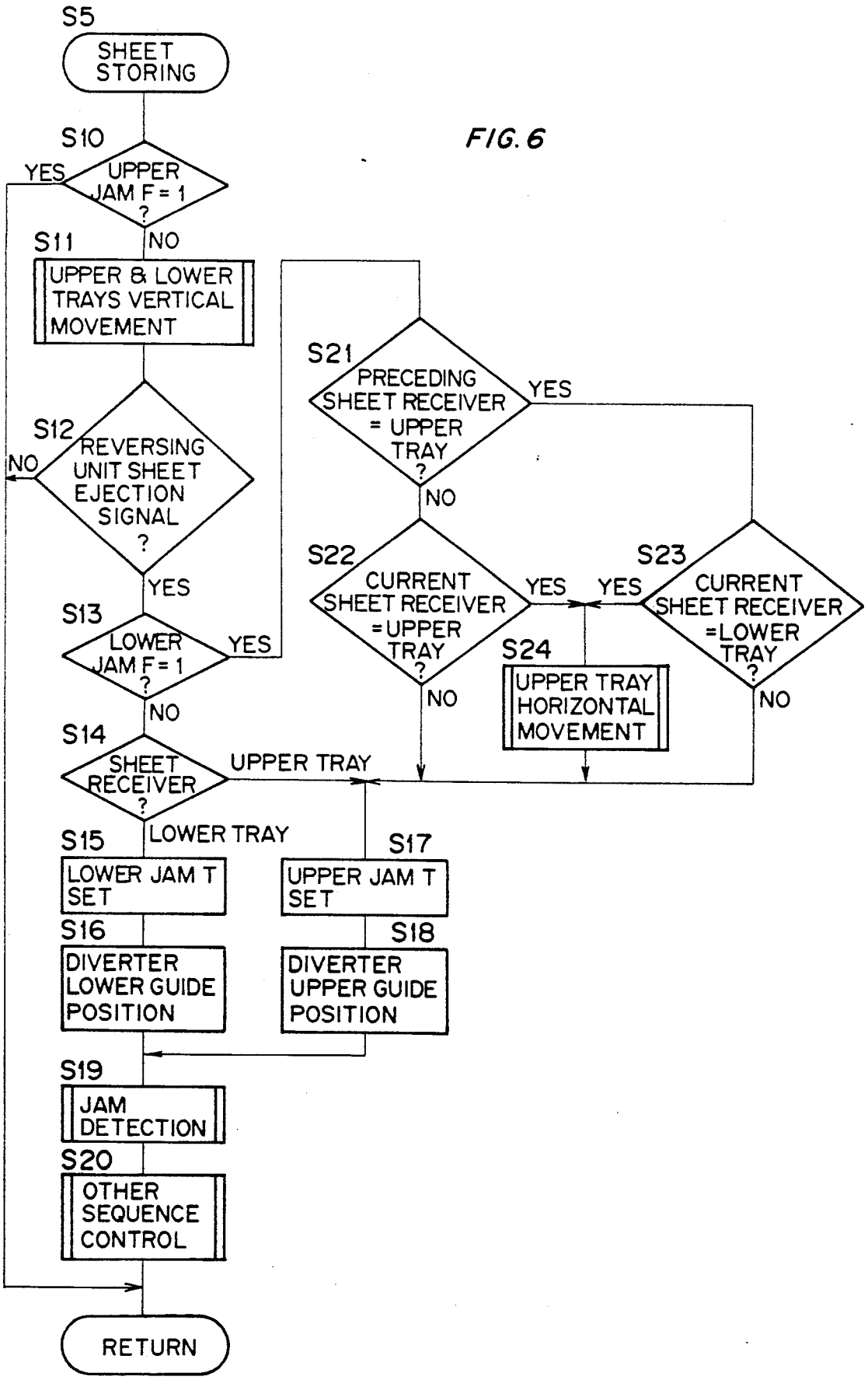

FIG. 6 shows the sheet storing subroutine carried out at step S5.

First, an upper jam flag is checked at step S10. This flag is set to "1" when sheet jamming occurs in a sheet path leading to the upper tray 70 (see step S42 in FIG. 7). In a case of sheet jamming in the upper sheet path, the trailing end of the jammed sheet may remain near the diverter 67, and it is impossible to transport successive sheets to the lower tray 70*a*. Therefore, when sheet jamming takes place in the upper sheet path ("YES" at step S10), this subroutine is terminated immediately. When there is no sheet jamming in the upper sheet path ("NO" at step S10), vertical movement processing is performed at step S11. In the vertical movement processing, the vertical motors 74 and 74*a* are controlled in accordance with signals from the sensors SE3 and SE3*a* so as to maintain the trays 70 and 70*a* in their appropriate positions.

Next, it is judged at step S12 whether a signal representing ejection of a sheet from the sheet reversing unit 50 has been generated. This signal is sent from the processor 102 to the processor 103 when a sensor (not shown) detects that the leading edge of a sheet reaches the exit of the sheet reversing unit 50. When generation of the signal is confirmed at step S12, a lower jam flag is checked at step S13. This flag is set to "1" when sheet jamming occurs in a sheet path leading to the lower tray 70*a* (see step S36 in FIG. 7). When there is no sheet jamming in the lower sheet path ("NO" at step S13), it is recognized at step S14 which tray 70 or 70*a* is programmed to receive the sheet being transported from the sheet reversing unit 50. When it is recognized at step S14 that the lower tray 70*a* is programmed to receive the sheet, a lower jam timer is set at step S15, and the diverter 67 is set in a lower guide position at step S16 to guide the sheet to the lower tray 70*a*. Then, the processing goes to step S19. When it is recognized at step S14 that the upper tray 70 is programmed to receive the sheet, an upper jam timer is set at step S17, and the diverter 67 is set in an upper guide position at step S18 to guide the sheet to the upper tray 70. Then, the processing goes to step S19.

Step S19 is a step to detect occurrence of sheet jamming, and this step will be described later referring to FIG. 7. At step S20, other sequence control for sheet transportation, horizontal movements of the trays 70 and 70*a*, etc. is performed.

On the other hand, when sheet jamming in the lower sheet path is detected ("YES" at step S13), it is recognized at step S21 whether the upper tray 70 received the immediately preceding sheet. Then, it is recognized at steps S22 and S23 which tray 70 or 70*a* is programmed to receive the sheet being transported from the sheet reversing unit 50. When it is recognized that the upper tray 70 received the immediately preceding sheet and that the lower tray 70*a* is programmed to receive the currently transported sheet ("YES" at steps S21 and S23), and when it is recognized that the lower tray 70*a* received the immediately preceding sheet and that the upper tray 70 is programmed to receive the currently transported sheet ("NO" at step S21 and "YES" at step S22), the processing goes to step S24, where the upper tray 70 is moved horizontally by one step. Then, the processing goes to steps S17 and S18 so that the currently transported sheet can be guided to the upper tray 70. When it is recognized that the upper tray 70 received the immediately preceding sheet and is programmed to receive the currently transported sheet ("YES" at step S21 and "NO" at step S23), and when it is recognized that the lower tray 70*a* received the immediately preceding sheet and is programmed to receive the currently transported sheet ("NO" at steps S21 and S22), the processing skips step S24 and goes to steps S17 and S18.

Under the control, when sheet jamming occurs in the lower sheet path, successive sheets are transported to the upper tray 70. With this control system, when sheet jamming occurs in the sheet storing unit 60, printing operation of the printer body 1 need not always be discontinued. Since the upper tray 70 is moved horizontally by one step before receiving sheets after the jamming, the sheets can be distinguished from those before the jamming.

Figure 7:
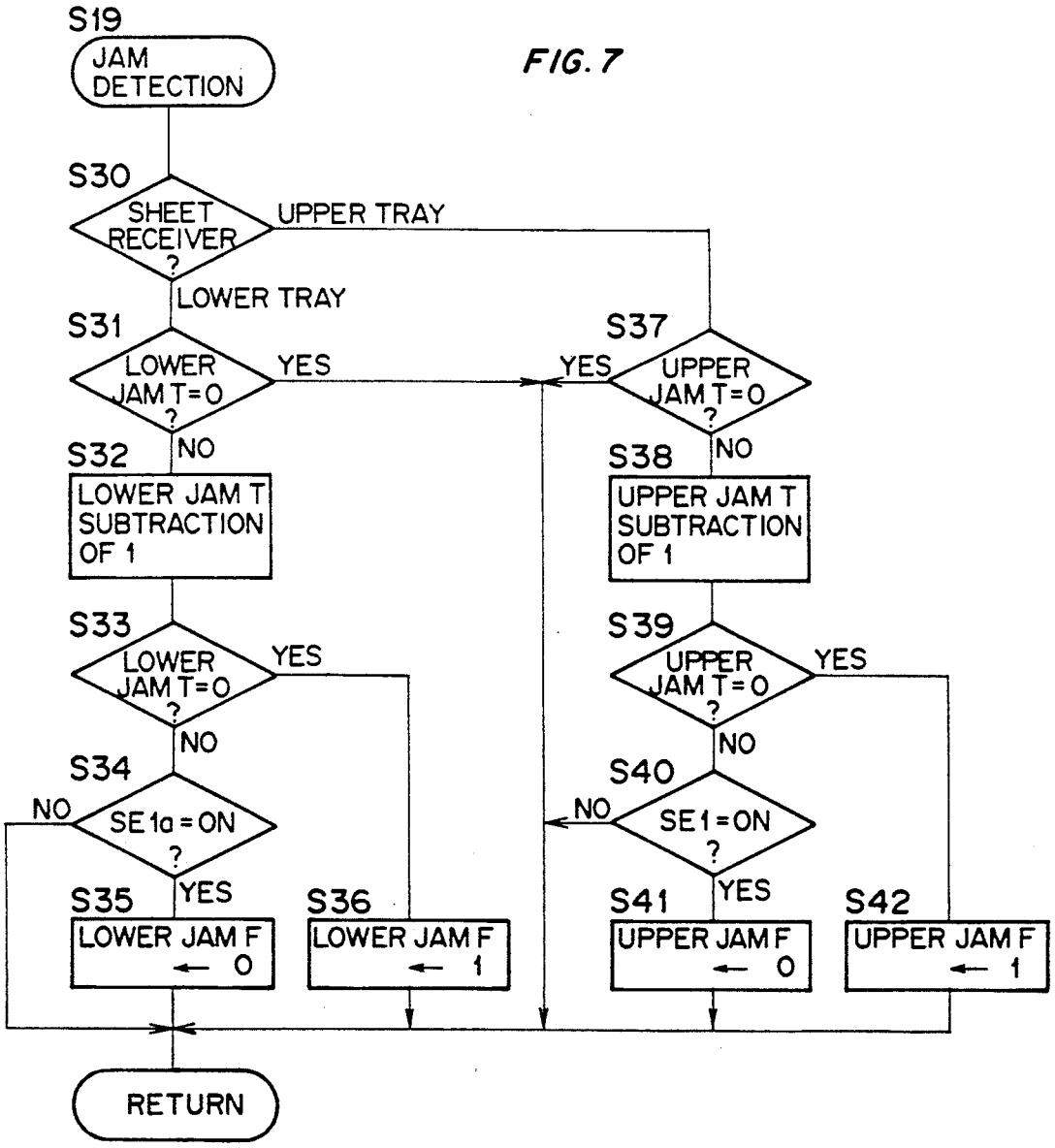

FIG. 7 shows a jam detection subroutine carried out at step S19.

It is recognized at step S30 which tray 70 or 70*a* is programmed to receive the currently transported sheet. When the lower tray 70*a* is programmed to receive the sheet, it is judged at step S31 whether the lower jam timer has been reset to "0". This lower jam timer was set at step S15 in order to detect sheet jamming in the lower sheet path. The value set in this timer corresponds to a time which it normally takes a sheet to reach the sensor SE1*a* from the sensor (not shown) at the exit of the sheet reversing unit 50, plus a margin. At step S32, one is subtracted from the timer value, and the sensor SE1*a* is checked at step S34. That the sensor SE1*a* is turned on before expiration of the lower jam timer ("NO" at step S33 and "YES" at step S34) means that a sheet has been smoothly transported to the sensor SE1*a*, and the lower jam flag is reset to "0" at step S35. That the lower jam timer expires before turning-on of the sensor SE1*a* ("YES" at step S33) indicates occurrence of sheet jamming in the lower sheet path, and the lower jam flag is set to "1" at step S36.

When it is judged at step S30 that the upper tray 70 is programmed to receive the sheet, the processing at steps 37 through S42 is performed. The processing here is similar to the processing at steps S31 through S36. The upper jam timer was set at step S17, and the value set in this timer corresponds to a time which it normally takes a sheet to reach the sensor SE1 from the sensor (not shown) at the exit of the sheet reversing unit 50, plus a margin. That the upper jam timer expires before turning-on of the sensor SE1 ("YES" at step S39) indicates occurrence of sheet jamming in the upper sheet path, and the upper jam flag is set to "1" at step S42.

SECOND EMBODIMENT: FIGS. 8–21

A second embodiment describes a sheet storing unit which can comply with trouble in the horizontal movement mechanism and/or in the vertical movement mechanisms. For example, when the vertical movement mechanism of the upper tray 70 malfunctions, the sheet storing unit 60 is so controlled that sheets are stacked on the lower tray 70*a*. In this second embodiment, as tabulated below, the sheet storing unit 60 is controlled in one of operation modes 1 through 9 in accordance with the conditions of the mechanisms. Further, an apparatus of the second embodiment comprises the same units as that of the first embodiment does.

TABLE

| | Upper Tray | | Lower Tray | |
|---|---|---|---|---|
| | Vertical | Horizontal | Vertical | Horizontal |
| Mode 1 | ○ | ○ | ○ | ○ |
| Mode 2 | ○ | ○ | ○ | X |
| Mode 3 | ○ | ○ | X | — |
| Mode 4 | ○ | X | ○ | ○ |
| Mode 5 | ○ | X | ○ | X |
| Mode 6 | ○ | X | X | — |
| Mode 7 | X | — | ○ | ○ |
| Mode 8 | X | — | ○ | X |
| Mode 9 | X | — | X | — |

○: Normal
X: Abnormal
—: Because of trouble in the vertical movement mechanism of the tray, sheet stacking on the tray is impossible, and the horizontal movement mechanism is not operated.

While all the horizontal and the vertical movement mechanisms operate normally, the sheet storing unit 60 performs sheet storing in mode 1 where no special measures are took into effect.

When the horizontal movement mechanism of the lower tray 70*a* has motor trouble, the sheet storing unit 60 is controlled in mode 2. In mode 2, when the lower tray 70*a* is commanded to move horizontally, the upper tray 70 is moved horizontally by one step instead, and successive sheets are stacked on the upper tray 70.

When the vertical movement mechanism of the lower tray 70*a* has motor trouble, the sheet storing unit 60 is controlled in mode 3. In this case, sheet stacking on the lower tray 70*a* is impossible. Therefore when sheets are programmed to be transported onto the lower tray 70*a*, the destination of the sheets is switched to the upper tray 70. Further, the upper tray 70 is moved horizontally by one step before receiving the sheets.

When the horizontal movement mechanism of the upper tray 70 has motor trouble, the sheet storing unit 60 is controlled in mode 4. In mode 4, when the upper tray 70 is commanded to move horizontally, the lower tray 70*a* is moved horizontally by one step instead, and successive sheets are stacked on the lower tray 70*a*.

When the both horizontal movement mechanisms of the upper and the lower trays 70 and 70*a* malfunction, the sheet storing unit 60 is controlled in mode 5. In mode 5, sheets are transported to the trays 70 and 70*a* in a predetermined way, but the trays 70 and 70*a* are not moved horizontally.

When the horizontal movement mechanism of the upper tray 70 and the vertical movement mechanism of the lower tray 70*a* malfunction, the sheet storing unit 60 is controlled in mode 6. In mode 6, sheets are transported only onto the upper tray 70, and the upper tray 70 is not moved horizontally.

When the vertical movement mechanism of the upper tray 70 malfunctions, the sheet storing unit 60 is controlled in mode 7. In this case, sheet stacking on the upper tray 70 is impossible. Therefore even when sheets are programmed to be transported onto the upper tray 70, the destination of the sheets is switched to the lower tray 70*a*. Further, the lower tray 70*a* is moved horizontally by one step before receiving the sheets.

When the vertical movement mechanism of the upper tray 70 and the horizontal movement of the lower tray 70*a* malfunction, the sheet storing unit 60 is controlled in mode 8. In mode 8, sheets are transported only onto the lower tray 70*a*, and the tray 70*a* is not moved horizontally.

When all the horizontal and the vertical movement mechanisms malfunction, the sheet storing unit 60 is controlled in mode 9 so as to cancel the sheet storing.

A control procedure according to the second embodiment is hereinafter described, referring to FIGS. 8 through 21.

A main routine of the CPU 120 here is the same as that of the first embodiment shown in FIG. 5.

Figure 8:
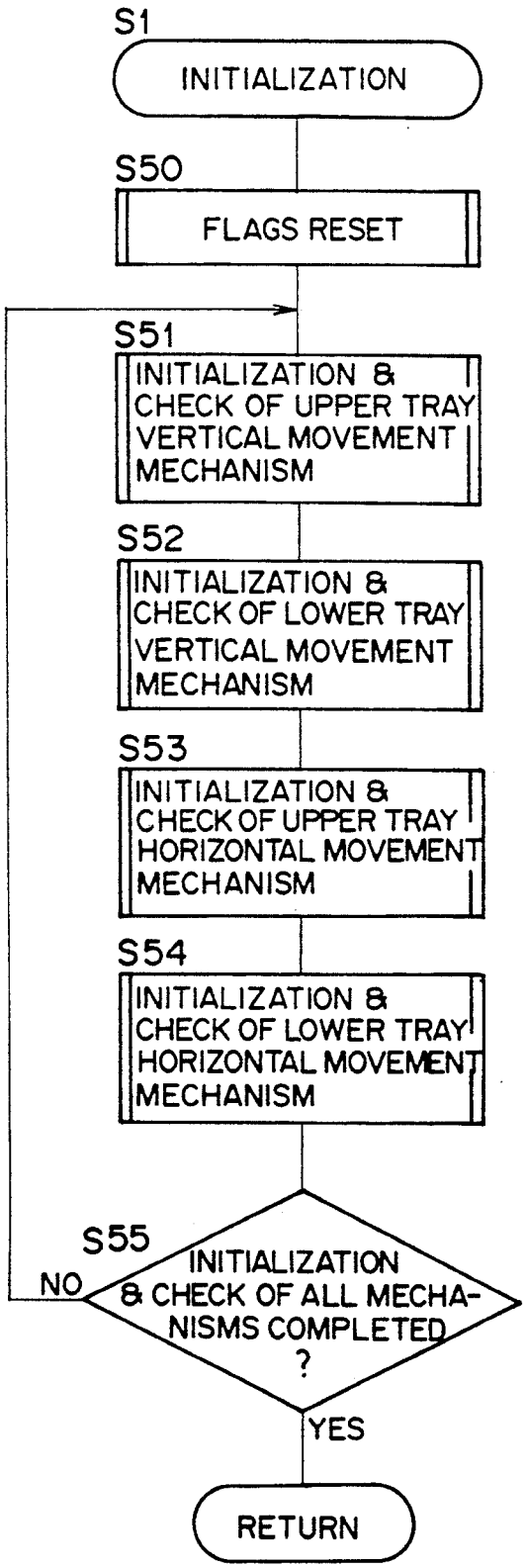

FIG. 8 shows a subroutine carried out at the initialization step S1.

In this second embodiment, when the sheet storing unit 60 is turned on, the horizontal and the vertical movement mechanisms are initialized and checked. In accordance with the result of the check, the sheet storing unit 60 is controlled in one of modes 1 through 9.

First, flags are reset at step S50, and the vertical and the horizontal movement mechanisms of the upper and the lower trays 70 and 70*a* are initialized and checked at steps S51 through S54. When it is judged at step S55 that all the motors 73, 73*a*, 74 and 74*a* have been checked, this subroutine is completed.

Figure 9:
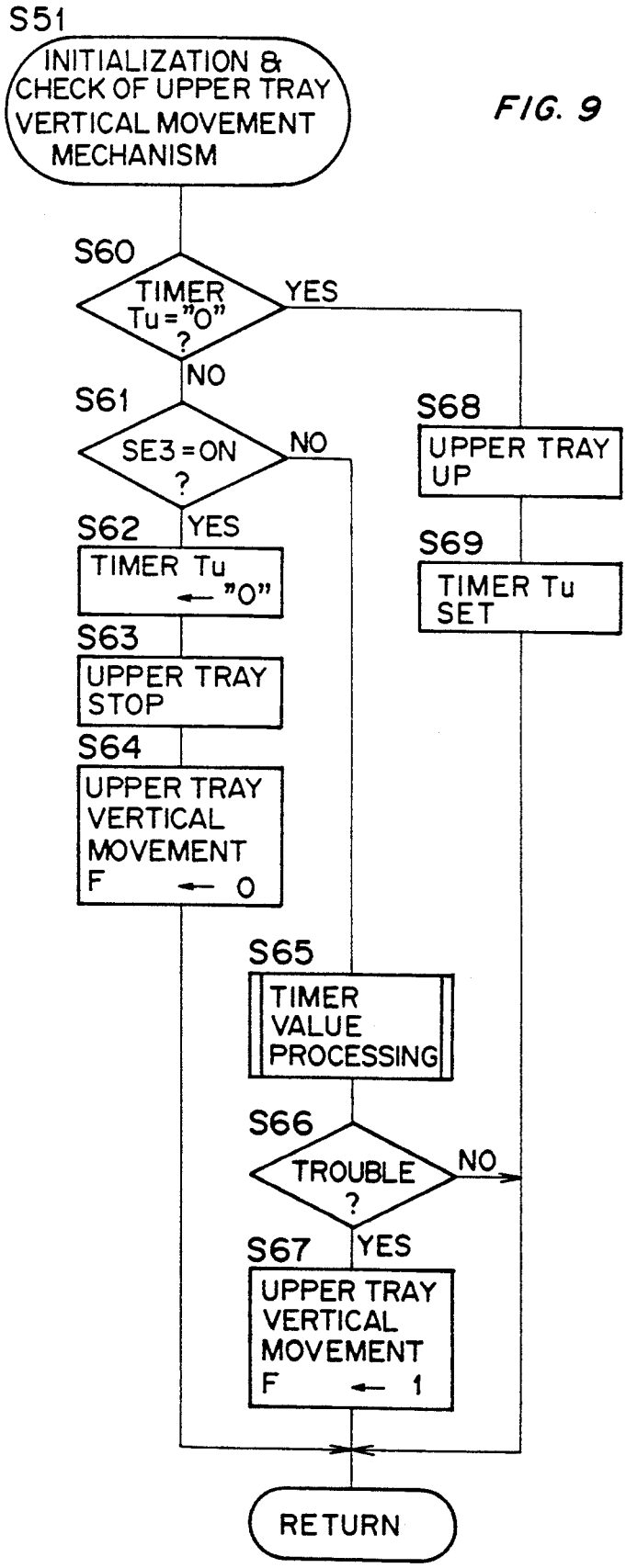

FIG. 9 shows the initialization of the vertical movement mechanism of the upper tray 70 performed at step S51. The other mechanisms are initialized in the same manner as described below.

Figure 10:
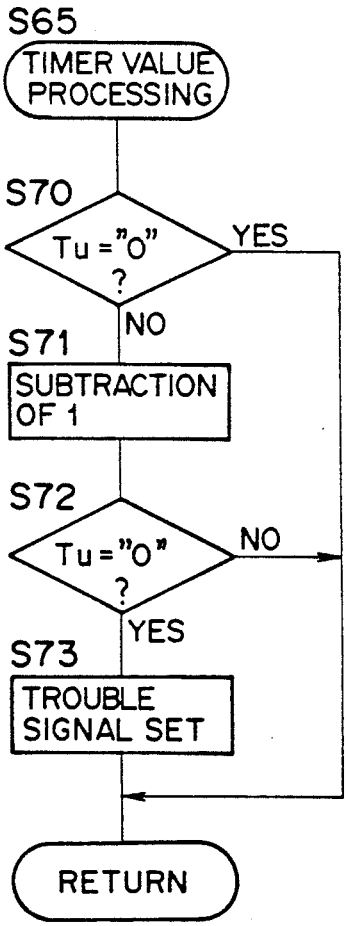

First, an upper tray vertical movement timer Tu is checked at step S60. When the value of the timer Tu is "0" at step S60, the motor 74 is rotated at step S68 to move up the upper tray 70, and the timer Tu is set at step S69. The value set in the timer Tu corresponds to a time which it normally takes the upper tray 70 to move from its lowermost position to its uppermost position (initial position), plus a margin. When the timer Tu is judged not to be "0" at step S60, the upper limit sensor SE3 is checked at step S61. That the sensor SE3 is judged to be on at step S61 means that the upper tray 70 arrived in the initial position within the time set in the timer Tu. In this case, the vertical movement mechanism of the upper tray 70 is normal, and the timer Tu is reset to "0" at step S62. Then, the vertical motor 74 is turned off at step S63 to stop the upward movement of the upper tray 70, and an upper tray vertical movement flag is reset to "0" at step S64. This flag indicates that the vertical movement mechanism of the upper tray 70 is abnormal, when it is "1".

when the sensor SE3 is judged to be off at step S61, the value of the timer Tu is processed at step S65 (see FIG. 10). Then, it is judged at step S66 whether trouble occurs in this mechanism. When the occurrence of trouble is recognized, the upper tray vertical movement flag is set to "1" at step S67.

FIG. 10 shows a subroutine for processing the value of the upper tray vertical movement timer Tu, which is carried out at step S65. Further, during the initialization of the other mechanisms performed at steps S52, S53 and S54, the values of timers are processed in the same manner in the same situations as described below.

When the timer value is judged not to be "0" at step S70, one is subtracted from the timer value at step S71. Then, the value is again checked at step S72. When the timer value is judged to be "0" at step S72, which means that the tray 70 did not arrive in its initial position within the time set in the timer Tu, a trouble signal is generated at step S73. From this signal, the occurrence of trouble is recognized at step S66.

Figure 11A:
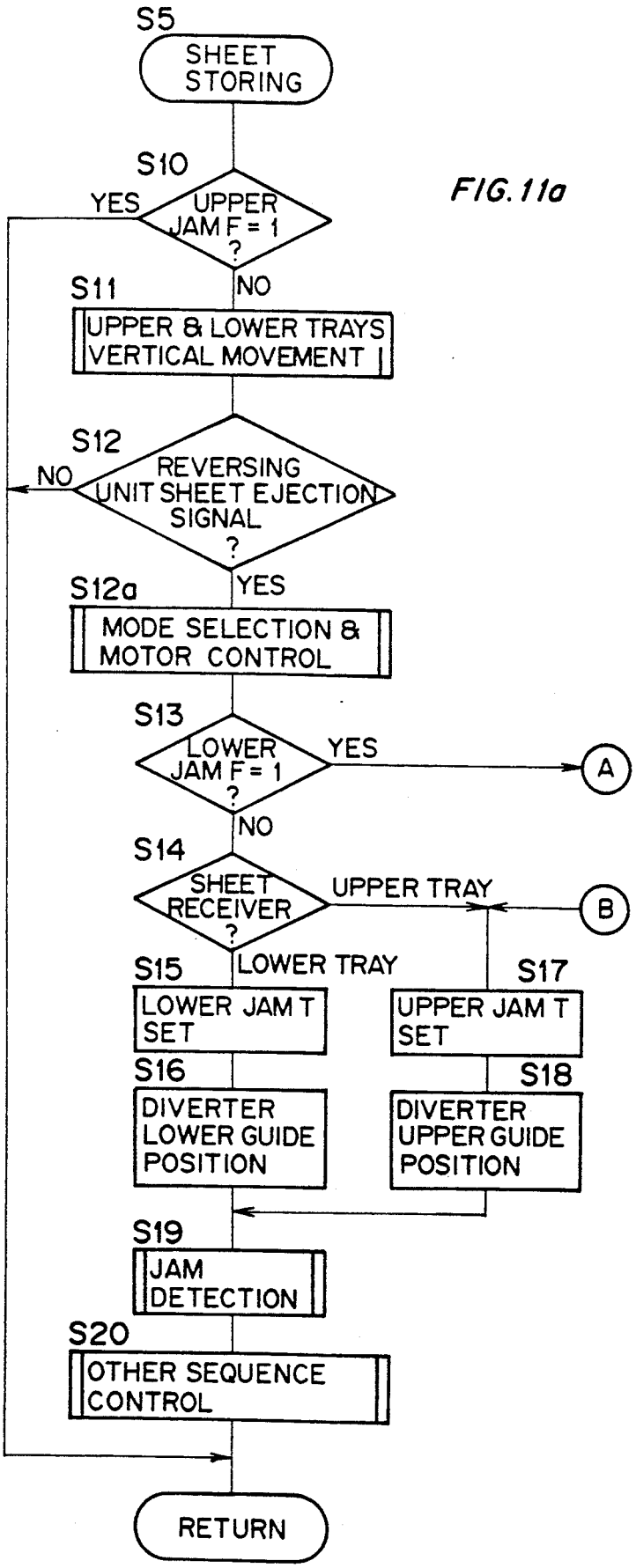
FIG. 11*a* and 11*b* are flowcharts showing a subroutine for sheet storing.
Figure 11B:
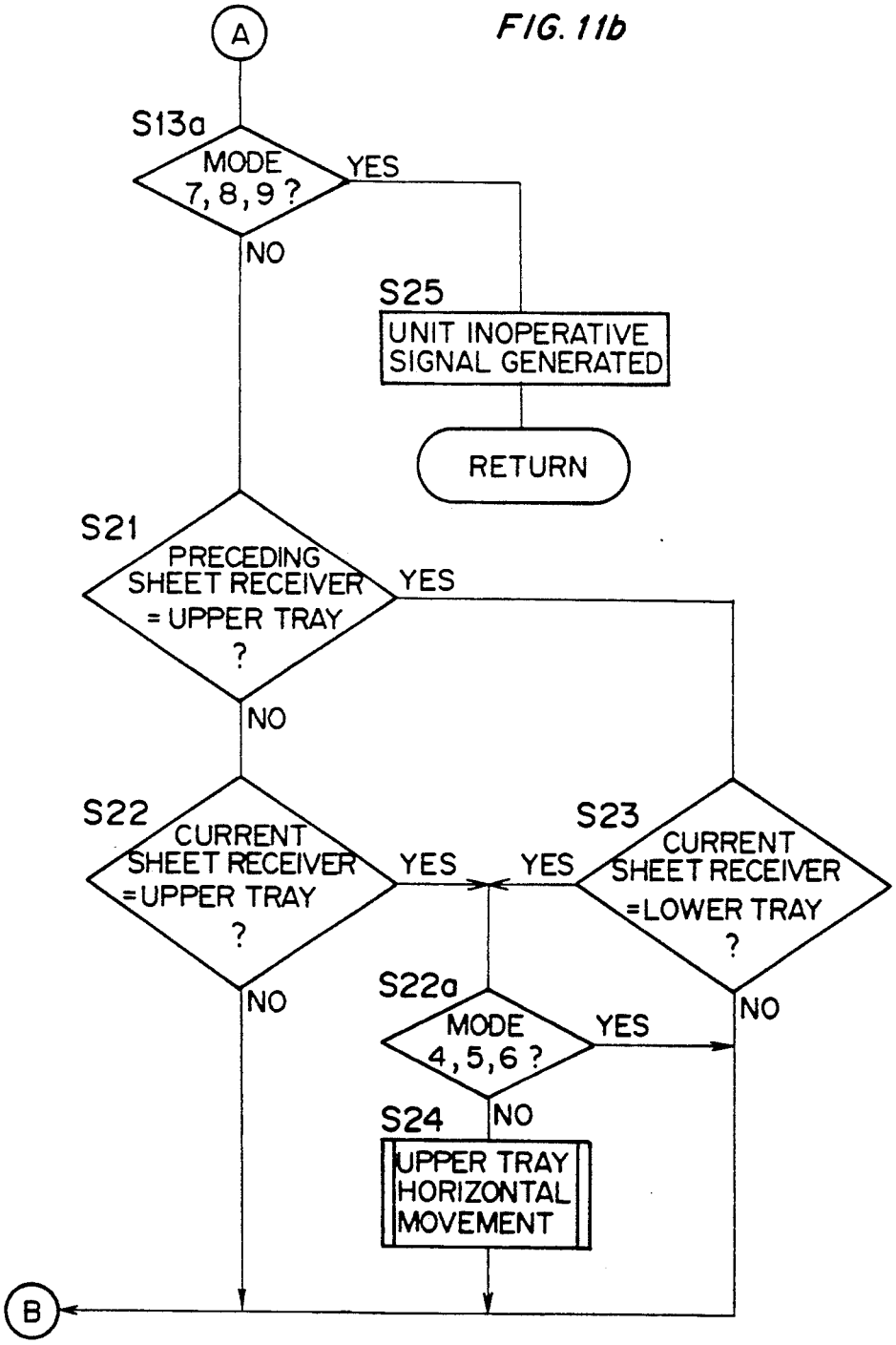

FIGS. 11*a* and 11*b* show a subroutine for sheet storing carried out at step S5 in the main routine. This subroutine is similar to the sheet storing subroutine of the first embodiment shown in FIG. 6.

The sheet storing subroutine of the second embodiment is hereinafter described, focusing on differences from that of the first embodiment. When the signal representing ejection of a sheet from the sheet reversing unit 50 is generated at step S12, an operation mode is selected at step S12*a*. At this step, one of modes 1 through 9 is selected in accordance with the result of the check of the horizontal and the vertical movement mechanisms at the initialization steps, and the motors are controlled in the selected mode. When sheet jamming takes place in the lower sheet path ("YES" at step S13), it is judged at step S13*a* whether or not the operation mode is one of modes 7, 8 and 9. That the operation mode is mode 7, 8 or 9 ("YES" at step S13*a*) means that the vertical mechanism of the upper tray 70 does not operate normally. In this case, sheet stacking on the upper tray 70 is impossible. Accordingly, a signal indicating that the sheet storing unit 60 is inoperative is generated at step S25, and this subroutine is terminated. This signal is transmitted to the interface processor 115 at step S2 in the main routine, and thereby the printing is discontinued. Then, it is judged at step S4 that the printing is not performed, and the processing does not come to the sheet storing step. When it is judged at step S13*a* that the operation mode is none of modes 7, 8 and 9 ("NO" at step S13*a*), as already described referring to FIG. 6, which tray 70 or 70*a* received the immediately preceding sheet and which tray 70 or 70*a* is programmed to receive the currently transported sheet are recognized at steps S21, S22 and S23. Immediately before moving the upper tray 70 horizontally, it is judged at step S22*a* whether or not the operation mode is one of modes 4, 5 and 6. When the operation mode is mode 4, 5 or 6, which means that the horizontal movement mechanism of the upper tray 70 is abnormal, the processing skips the tray horizontal movement step S24 and goes to steps S17 and S18.

Jam detection carried out at step S19 is the same as that of the first embodiment, of which subroutine is shown in FIG. 7.

Figure 12:
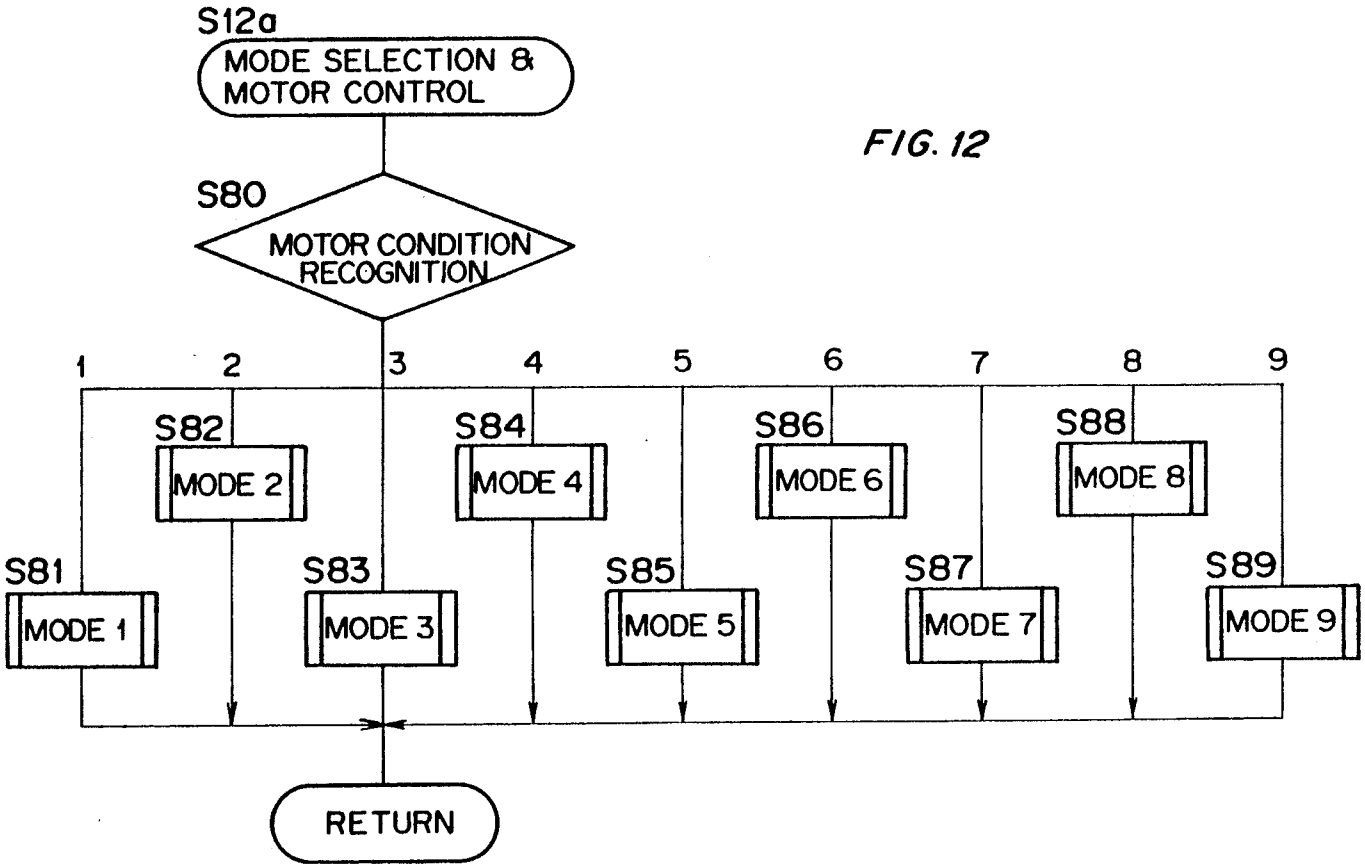

FIG. 12 shows a subroutine for the mode selection and motor control carried out at step S12*a*.

At step S80, an operation mode is selected from modes 1 through 9 in accordance with the conditions of the horizontal and the vertical movement mechanisms detected at the initialization step S1, and the motors are controlled in the selected mode at one of steps S81 through S89.

Figure 13:
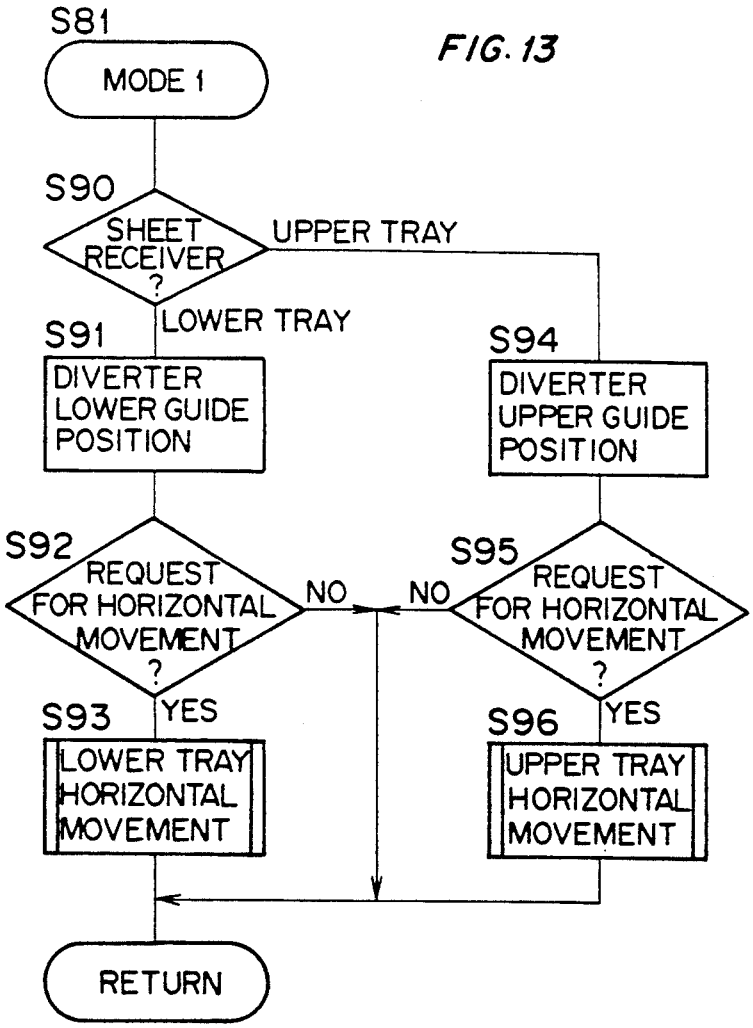

FIG. 13 shows a subroutine in mode 1. When it is judged at step S90 that the lower tray 70*a* is programmed to receive the sheet being transported from the sheet reversing unit 50, the diverter 67 is set in the lower guide position at step S91 to guide the sheet to the lower tray 70*a*. When a request for a tray horizontal movement is detected at step S92, the lower tray 70*a* is moved horizontally by one step at step S93. When it is judged at step S90 that the upper tray 70 is programmed to receive the currently transported sheet, the diverter 67 is set in the upper guide position at step S94 to guide the sheet to the upper tray 70. When a request for a tray horizontal movement is detected at step S95, the upper tray 70 is moved horizontally by one step at step S96.

Figure 14:
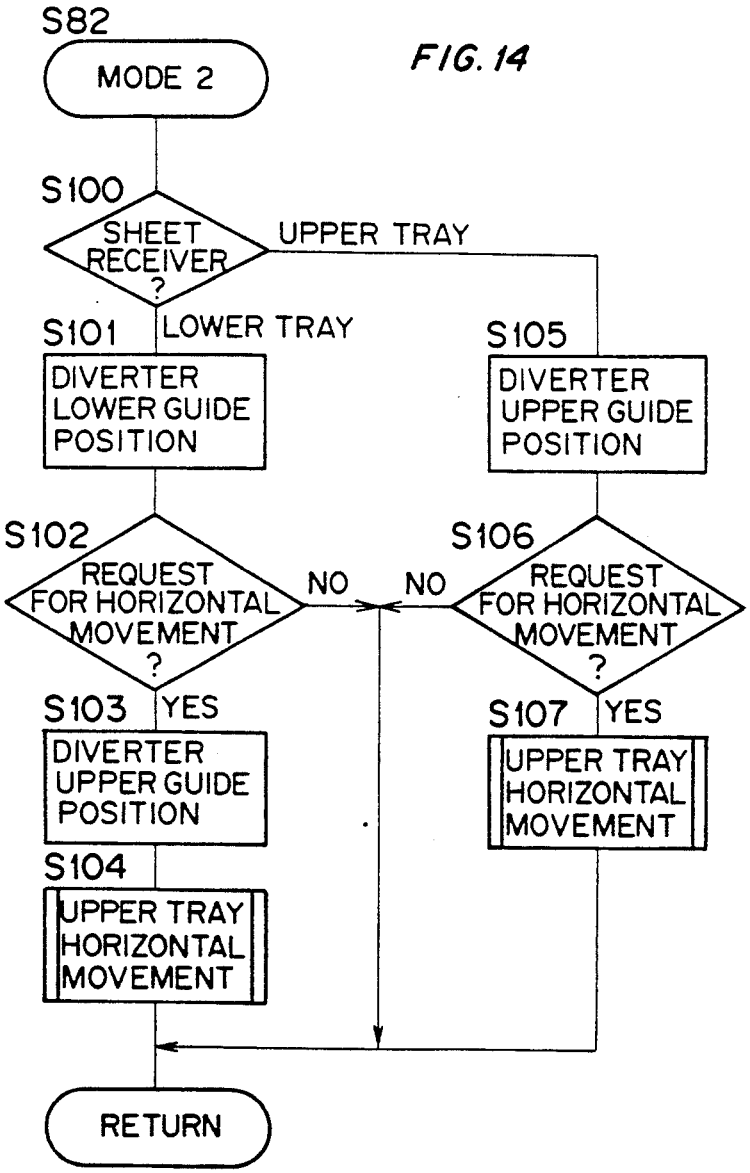

FIG. 14 shows a subroutine in mode 2. When it is judged at step S100 that the lower tray 70*a* is programmed to receive the currently transported sheet, the diverter 67 is set in the lower guide position at step S101 to guide the sheet to the lower tray 70*a*. Since the horizontal movement mechanism of the lower tray 70*a* does not operate normally, the sheet storing unit 60 is controlled as follows in response to a request for a horizontal movement of the lower tray 70*a*. When a request for a tray horizontal movement is detected at step S102, the position of the diverter 67 is switched to the upper guide position at step S103, and the upper tray 70 is moved horizontally by one step at step S104. Thereby the sheet is received on the upper tray 70, at a different place from the immediately preceding sheet. When it is judged at step S100 that the upper tray 70 is programmed to receive the currently transported sheet, the diverter 67 is set in the upper guide position at step S105 to guide the sheet to the upper tray 70. When a request for a tray horizontal movement is detected at step S106, the upper tray 70 is moved horizontally by one step at step S107.

Figure 15:
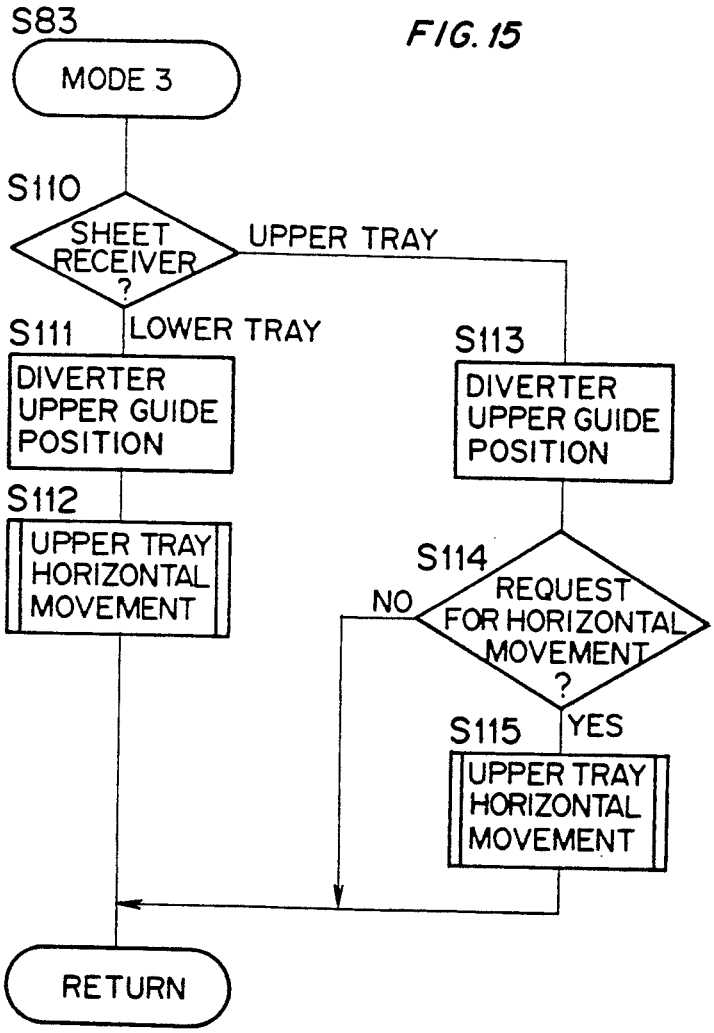

FIG. 15 shows a subroutine in mode 3. Because the lower tray 70*a* is not possible to use, the sheet storing unit 60 is controlled as follows to transport every sheet onto the upper tray 70. When it is judged at step S110 that the lower tray 70*a* is programmed to receive the currently transported sheet, the diverter 67 is set in the upper guide position at step S111 to guide the sheet to the upper tray 70, and the upper tray 70 is moved horizontally by one step at step S112. Thereby the sheet is received on the upper tray 70, at a different place from the immediately preceding sheet. When it is judged at step S110 that the upper tray 70 is programmed to receive the currently transported sheet, the diverter 67 is set in the upper guide position to guide the sheet to the upper tray 70. When a request for a tray horizontal movement is detected at step S114, the upper tray 70 is moved horizontally by one step at step S115.

Figure 16:
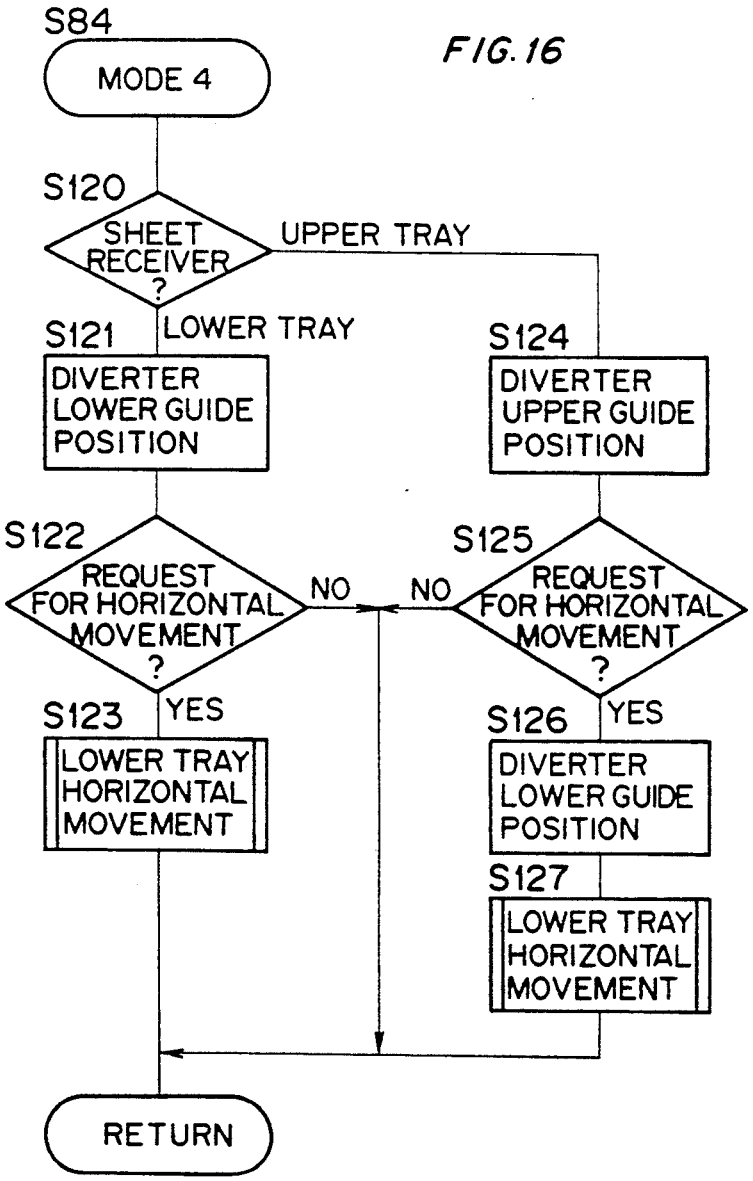

FIG. 16 shows a subroutine in mode 4. When it is judged at step S120 that the lower tray 70*a* is programmed to receive the currently transported sheet, the diverter 67 is set in the lower guide position at step S121 to guide the sheet to the lower tray 70*a*. When a request for a tray horizontal movement is detected at step S122, the lower tray 70*a* is moved horizontally by one step at step S123. When it is judged at step S120 that the upper tray 70 is programmed to receive the currently transported sheet, the diverter 67 is set in the upper guide position at step S124 to guide the sheet to the upper tray 70. Since the horizontal mechanism of the upper tray 70 does not operate normally, the sheet storing unit 60 is controlled as follows in response to a request for a horizontal movement of the upper tray 70. When a request for a tray horizontal movement is detected at step S125, the position of the diverter 67 is switched to the lower guide position at step S126, and the lower tray 70*a* is moved horizontally by one step at step S127. Thereby the sheet is received on the lower tray 70*a*, at a different place from the immediately preceding sheet.

Figure 17:
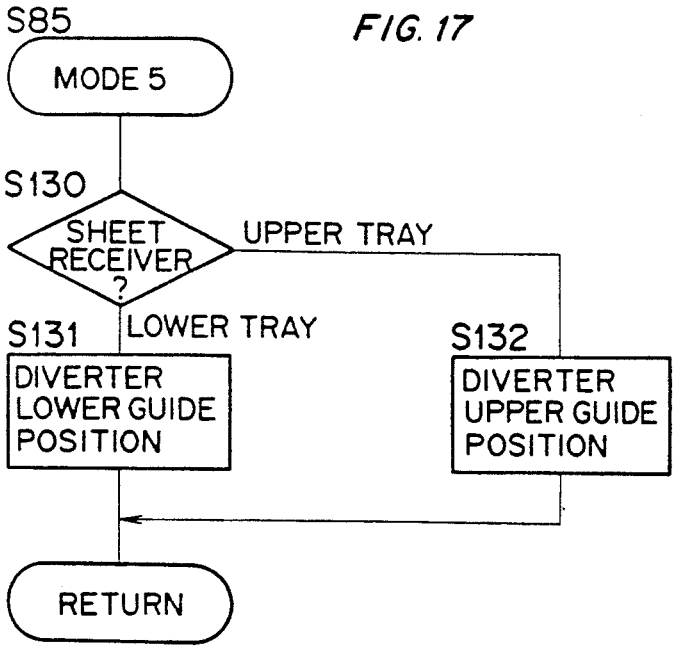

FIG. 17 shows a subroutine in mode 5. When it is judged at step S130 that the lower tray 70*a* is programmed to receive the currently transported sheet, the diverter 67 is set in the lower guide position at step S131 to guide the sheet to the lower tray 70*a*. When it is judged at step S131 that the upper tray 70 is programmed to receive the currently transported sheet, the diverter 67 is set in the upper guide position at step S132 to guide the sheet to the upper tray 70. In this case, since the both horizontal movement mechanisms of the upper and the lower trays 70 and 70*a* do not operate normally, any request for a tray horizontal movement is ignored.

Figure 18:
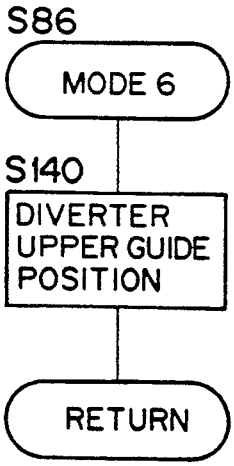

FIG. 18 shows a subroutine in mode 6. This is a situation where the lower tray 70*a* is impossible to use and the upper horizontal movement mechanism malfunctions. Accordingly, the diverter 67 is set in the upper guide position at step S140, and every sheet is received on the upper tray 70.

Figure 19:
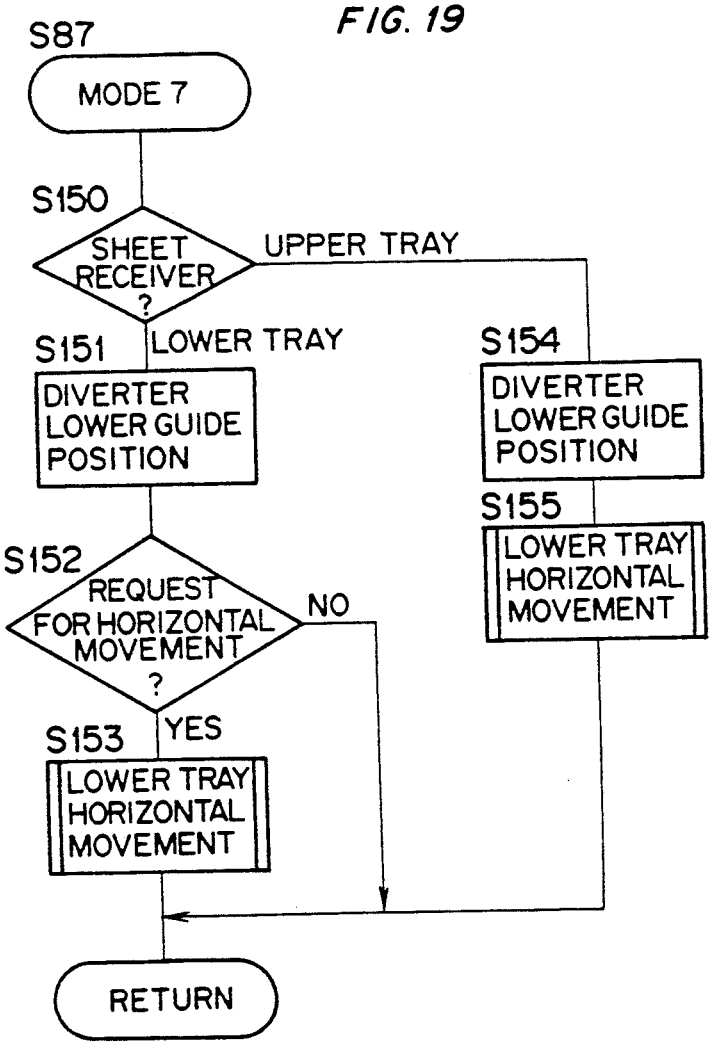

FIG. 19 shows a subroutine in mode 7. When it is judged at step S150 that the lower tray 70*a* is programmed to receive the currently transported sheet, the diverter 67 is set in the lower guide position at step S151 to guide the sheet to the lower tray 70*a*. When a request for a tray horizontal movement is detected at step S152, the lower tray 70*a* is moved horizontally by one step at step S153. In this case, since the upper tray 70 is impossible to use, even when it is judged at step S150 that the upper tray 70 is programmed to receive the currently transported sheet, the diverter 67 is set in the lower guide position at step S154. Then, the lower tray 70*a* is moved horizontally by one step at step S155. Thereby the sheet is received on the lower tray 70*a*, at a different place from the immediately preceding sheet.

Figure 20:
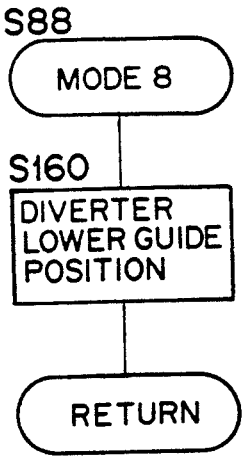

FIG. 20 shows a subroutine in mode 8. This is a situation where the upper tray 70 is impossible to use and the lower horizontal movement mechanism malfunctions. Accordingly, the diverter 67 is set in the lower guide position at step S160, and every sheet is received on the lower tray 70*a*.

Figure 21:
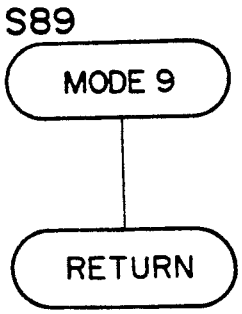

Selection of mode 9 indicates a situation where the both vertical movement mechanisms of the upper and the lower trays 70 and 70*a* malfunction, and in this situation sheet storing is impossible. Accordingly, as shown in FIG. 21, the processing returns to the main routine immediately.

OTHER EMBODIMENTS

Although the present invention has been described in connection with the preferred embodiments, it is to be noted that various changes and modifications are apparent to those who are skilled in the art. Such changes and modifications are to be understood as being within the scope of the present invention as defined by the appended claims.

For example, in the second embodiment, it is preferred that a trouble indicator is provided on the operation panel so as to inform the operator of necessity of calling a serviceman.

What is claimed is:

1. A sheet storing apparatus for stacking sheets discharged from an image forming machine and storing the sheets therein, the sheet storing apparatus comprising:

a plurality of sheet storing means each of which has driving means to enable independent sheet storing operation and a tray on which sheets are stacked, said driving means including a mechanism for moving the tray horizontally at predetermined intervals;

detection means for detecting failure in the sheet storing operation of each of the sheet storing means; and control means for, when the detection means detects failure in the sheet storing operation of one of the sheet storing means, controlling another sheet storing means which is operative normally to move the tray thereof horizontally and to stack successive sheets on the tray.

2. The sheet storing apparatus of claim 1, wherein each of the sheet storing means further comprises a mechanism for moving the tray vertically in accordance with the amount of a sheet stack thereon.

3. The sheet storing apparatus of claim 1, wherein the detection means employs a combination of a sheet sensor and a timer to detect failure in the sheet storing operation.

4. A sheet storing apparatus for stacking sheets discharged from an image forming machine and storing the sheets therein, the sheet storing apparatus comprising:

a plurality of sheet storing means which have separate driving means to enable independent sheet storing operation;

detection means for detecting a malfunction of each of the driving means; and control means for, when the detection means detects a malfunction of one of the driving means, controlling another driving means to drive the corresponding sheet storing means to perform the sheet storing operation.

5. The sheet storing apparatus of claim 4, wherein each of the sheet storing means comprises a tray on which sheets are stacked, and each of the driving means comprises a mechanism for moving the tray horizontally at predetermined intervals and a mechanism for moving the tray vertically in accordance with the amount of a sheet stack on the tray.

6. The sheet storing apparatus of claim 4, wherein the detection means operates simultaneously with applying power to the sheet storing apparatus.

7. A sheet storing apparatus comprising:

first and second sheet storing means each of which comprises a tray on which sheets discharged from an image forming machine are stacked, a mechanism for moving the tray horizontally at predetermined intervals, and a mechanism for moving the tray vertically in accordance with the amount of a sheet stack on the tray;

detection means for detecting a malfunction of each of the horizontal movement mechanism and the vertical movement mechanism of the first and the second sheet storing means; and control means for, when the detection means detects a malfunction of the vertical movement mechanism of the first sheet storing means, controlling the second sheet storing means to perform the sheet storing operation as long as the vertical movement mechanism of the second sheet storing means is operative normally, and vice versa.

8. The sheet storing apparatus of claim 7, wherein the detection means operates simultaneously with applying power to the sheet storing apparatus.

9. The sheet storing apparatus of claim 7, wherein when the detection means detects a malfunction of the horizontal movement mechanism of the second sheet storing means, the sheet storing apparatus is so controlled by the control means that the tray of the first sheet storing means is moved horizontally at a time when the tray of the second sheet storing means is programmed to move horizontally and that successive sheets are received on the tray of the first sheet storing means.

10. The sheet storing apparatus of claim 7, wherein when the detection means detects a malfunction of the vertical movement mechanism of the second sheet storing means, the sheet storing apparatus is so controlled by the control means that, at a time when a sheet programmed to be stored in the second sheet storing means enters the sheet storing apparatus, the tray of the first sheet storing means is moved horizontally and that the sheet and successive sheets are received on the tray of the first sheet storing means.

11. The sheet storing apparatus of claim 7, wherein when the detection means detects malfunctions of the horizontal movement mechanism of the first and the second sheet storing means, the sheet storing apparatus is so controlled by the control means that the trays of the first and the second sheet storing means receive sheets in a predetermined way but without moving horizontally.

12. The sheet storing apparatus of claim 7, wherein when the detection means detects a malfunction of the horizontal movement mechanism of the first sheet storing means and a malfunction of the vertical movement mechanism of the second sheet storing means, the sheet storing apparatus is so controlled by the control means that only the tray of the first sheet storing means receives sheets without moving horizontally.

13. A sheet storing apparatus for stacking sheets discharged from a printer and storing the sheets therein, the sheet storing apparatus comprising:

first and second sheet storing means each of which has driving means to enable independent sheet storing operation and a tray on which sheets are stacked, said driving means including a mechanism for moving the tray horizontally at predetermined intervals;

detection means for detecting failure in the sheet storing operation of each of the sheet storing means;

redesignating means for redesignating the first or the second sheet storing means as a receiving portion of a sheet; and control means for, when the detection means detects failure in the sheet storing operation of one of the sheet storing means, controlling the redesignating means to redesignate the other sheet storing means as a receiving portion of a next sheet, whereby the sheet storing apparatus continues to receive sheets successively discharged from the printer.

14. The sheet storing apparatus of claim 13, wherein when the detection means detects failure in the sheet storing operation of one of the sheet storing means, control means controls the other sheet storing means which is operative normally to move the tray thereof horizontally and to stack successive sheets on the tray.

15. The sheet storing apparatus of claim 13, wherein each of the sheet storing means further comprises a mechanism for moving the tray vertically in accordance with the amount of a sheet stack thereon.

16. The sheet storing apparatus of claim 13, wherein the detection means employs a combination of a sheet sensor and a timer to detect failure in the sheet storing operation.

* * * * *